United States Patent [19]

Anderson

[11] 4,195,459

[45] Apr. 1, 1980

[54] FOUR CORNER WALL PANEL JOINT

[75] Inventor: John W. Anderson, Bradford Woods, Pa.

[73] Assignee: H. H. Robertson Company, Pittsburgh, Pa.

[21] Appl. No.: 932,331

[22] Filed: Aug. 9, 1978

[30] Foreign Application Priority Data

Aug. 27, 1977 [ES] Spain ..... 230.788[U]

[51] Int. Cl.[2] ..... E04B 2/72; E04C 2/26; E04C 2/34; E04B 1/68

[52] U.S. Cl. ..... 52/394; 52/309.9; 52/478; 52/521; 52/539; 52/540

[58] Field of Search ..... 52/520, 521, 533, 536, 52/537, 539, 540, 541, 478, 543, 309.9, 394

[56] References Cited

U.S. PATENT DOCUMENTS

| | | | |
|---|---|---|---|
| 2,216,206 | 10/1940 | McKee, Jr. | 52/537 |
| 2,762,470 | 9/1956 | Parkes et al. | 52/520 X |
| 3,111,787 | 11/1963 | Chamberlain | 52/540 X |
| 3,466,831 | 9/1969 | Lenoir | 52/537 X |
| 3,468,086 | 9/1969 | Warner | 52/540 X |
| 4,068,437 | 1/1978 | Byxbe et al. | 52/539 X |

*Primary Examiner*—Stephen J. Novosad

*Attorney, Agent, or Firm*—Harry B. Keck; George E. Manias

[57] ABSTRACT

A four corner joint between wall panels of the type comprising outer and inner skins connected by an insulating core, and having marginal connecting means formed along the opposite longitudinal edges of the outer skin. The outer and inner skins and the core coterminate at the upper ends of the lower wall panels. The outer skins of the upper wall panels have lapping ends which extend downwardly beyond the lower ends of the upper wall panels and which overlap the wall panels. The marginal connecting means are substantially entirely removed along the length of the lapping ends of the upper panels to preclude interfering with the interconnection of corresponding marginal connecting means in the lower wall panels.

4 Claims, 5 Drawing Figures

FOUR CORNER WALL PANEL JOINT

BACKGROUND OF THE INVENTION

1. Field of the Invention:

This invention concerns four corner joints formed between adjacent upper wall panels and adjacent lower wall panels, the wall panels being secured at the joint to a structural member of a building framework.

2. Description of the Prior Art:

Wall structures have been assembled by erecting plural courses of side lapped panels.

In one arrangement, the upper panels presented lower ends which overlapped the upper ends of the lower course. At each four corner joint, a region of four metal thicknesses existed which interfered with weather and vapor seals as well as the proper interfitting of adjacent and superjacent panels.

In another arrangement, a Z-shaped flashing member was interposed between the confronting transverse ends of upper and lower panels. See, for example, U.S. Pat. No. 3,807,103 (KAUTZ, et al).

SUMMARY OF THE INVENTION

The principal object of the invention is to provide a wall panel having an outer skin providing a lapping end at one end of the panel which is adapted to facilitate assembly of side-by-side upper wall panels in end-overlapped relation with side-by-side lower wall panels for the purpose of providing a four corner joint which is weather-tight and which is imperceptible thereby offering an aesthetically pleasing external appearance.

The four corner joint of the invention is assembled from wall panels of the type which comprise outer and inner skins connected by an insulating core, and have marginal connecting means formed along the opposite longitudinal edges of the outer skin. Marginal connecting means also may be provided along the opposite longitudinal edges of the inner skin.

The four corner joint of this invention is characterized in that the outer and inner skins and the core coterminate at the upper ends of the lower wall panels; and in that the inner skin and the core coterminate at the lower ends of the upper wall panels and confront the upper ends of the lower wall panels. The four corner joint is further characterized in that the outer skins of the upper wall panels have lapping ends which extend beyond the lower ends of the upper wall panels and which overlap the lower wall panels; and in that the marginal connecting means are substantially entirely removed along the length of the lapping ends to preclude interfering with the interconnection of corresponding marginal connecting means in the lower wall panels.

The joint is further characterized in that the marginal connecting means comprise a tongue, and a channel which defines a complementary groove; and in that along the length of the lapping end, a longitudinal edge strip of the tongue is removed and the channel is removed in its entirety.

DESCRIPTION OF THE PREFERRED EMBODIMENT(S)

Figure 1:
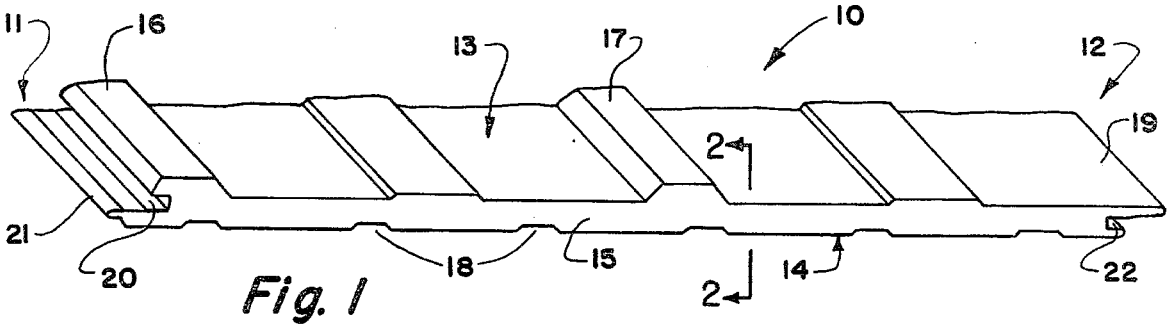
FIG. 1 is a fragmentary isometric view of a wall panel.

The four corner joint of this invention is assembled from wall panels, such as the composite wall panel 10 illustrated in FIG. 1. The composite wall panel 10 has opposite longitudinal sides 11, 12 and is assembled from outer and inner skins 13, 14 and an insulating core 15 which connects the outer skin 13 in shear-transferring relation to the inner skin 14. The inner and outer skins 13, 14 may be formed from sheet metal having a thickness of about 0.50 millimeter. The skins 13, 14 may have an embossed pattern and may have a decorative coating applied to the exterior surfaces thereof. The insulating core 15 may comprise any suitable insulating material. Preferably, the insulating core 15 comprises a foamed plastic material, such as polyurethane which is foamed-in-place between the skins 13, 14. To improve the span capabilities of the wall panel 10, the outer skin 13 may be provided with upstanding ribs 16, 17. The upstanding rib 16 is presented at the longitudinal side 11 of the panel 10 while the upstanding rib 17 is provided at a location intermediate of the opposite longitudinal sides 11, 12. The remaining portions of the outer skin 13 may be profiled, as illustrated in FIG. 1, to enhance the appearance of the exterior surface thereof. The inner skin 14 may be provided with uniformly spaced depressions 18 to enhance the appearance of the interior surface thereof.

The composite panel 10 may also be provided with marginal connecting means, such as a first tongue 19 and a first complementary channel 20 formed along the opposite longitudinal edges of the outer skin 13; and marginal connecting means, such as a second tongue 21 and a second complementary channel 22 formed along the opposite longitudinal edges of the inner skin 14.

Figure 2:
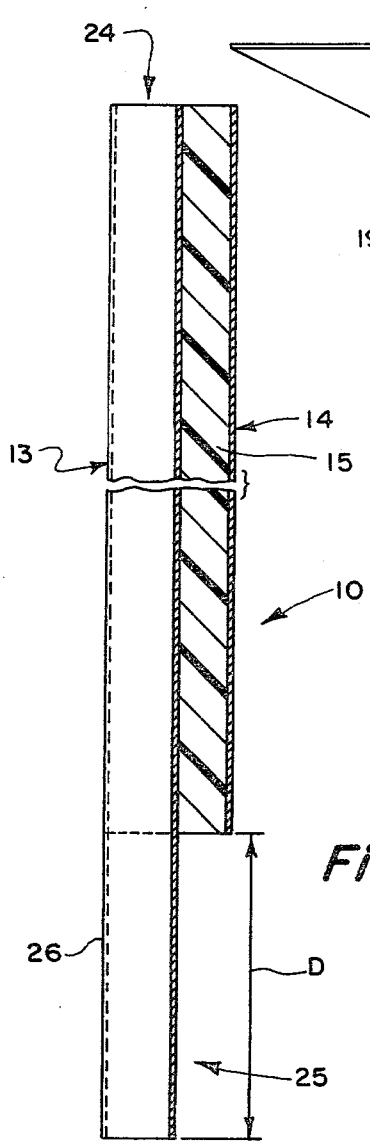
FIG. 2 is a broken cross-sectional view taken along the line 2—2 of FIG. 2.

Referring to FIG. 2, the composite panel 10 presents a first or upper end 24 where the outer and inner skins 13, 14 and the insulating core 15 coterminate. The composite panel 10 presents a second or lower end 25 where the inner skin 14 of the insulating core 15 coterminate but where the outer skin 13 extends beyond the flush ends of the inner skin 14 and the core 15 to provide a lapping end 26 having a length D.

Figure 3:
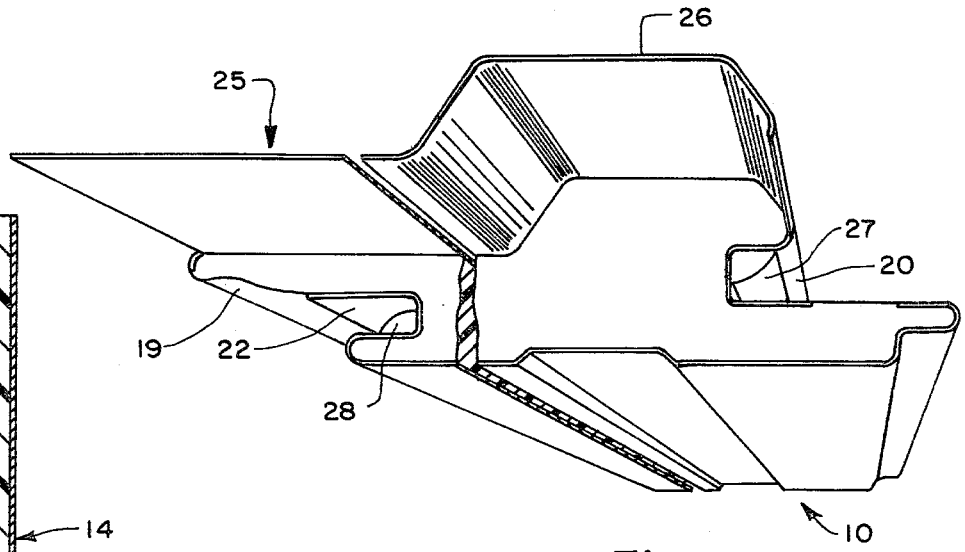
FIG. 3 is a broken perspective view illustrating a lapping end of the panel of FIG. 1, which is modified to permit formation of the four corner joint of this invention.

To facilitate formation of the four corner joint of this invention, the marginal connecting means are substantially entirely cut away, as shown in FIG. 3, along the entire length of the lapping end 21 to preclude interference with the interconnection of the corresponding marginal connecting means of lower wall panels. Specifically, the first tongue 19 has an edge strip thereof cut away whereas the channel 20 is cut away in its entirety.

As illustrated in FIG. 3, beads 27, 28 of a resilient sealing material are provided in and along the entire length of the first and second channels 20, 22 for the purpose of establishing weather-tight and vapor-tight seals between the inner and outer skins of adjacent wall panels.

Figure 4:
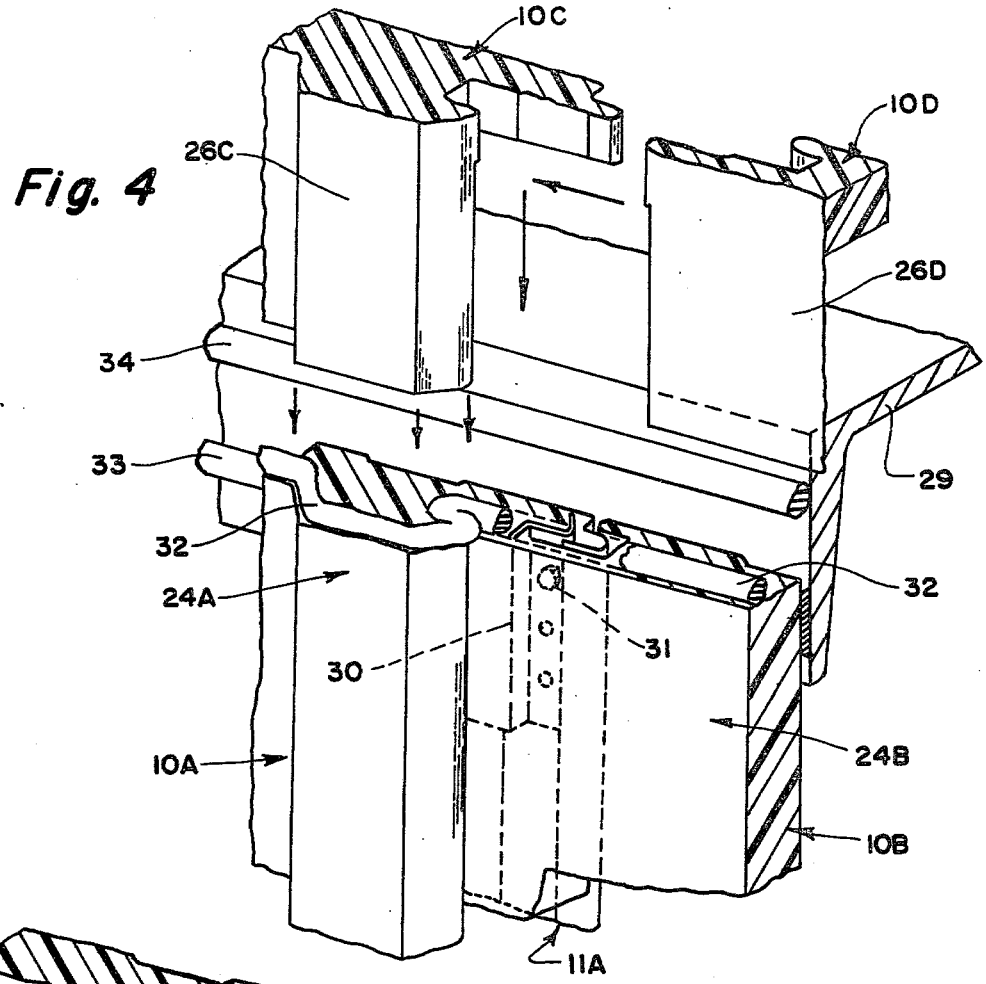
FIG. 4 is an exploded fragmentary isometric view of an incomplete four corner joint of this invention.
Figure 5:
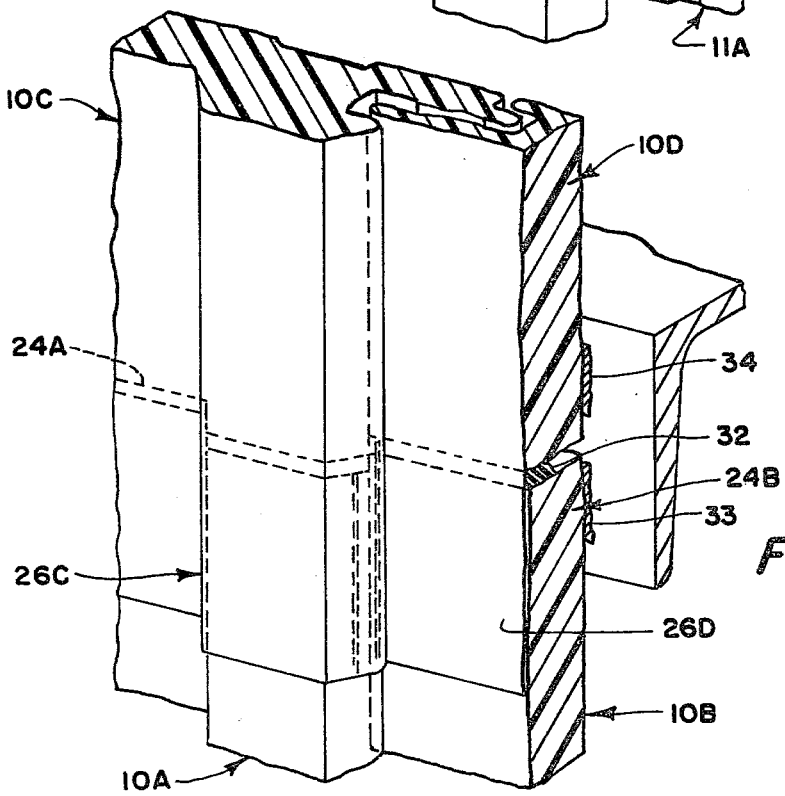
FIG. 5 is a fragmentary isometric view illustrating a completed four corner joint of this invention.

The order in which the wall panels 10 are assembled to form the four corner joint of this invention is illustrated in FIGS. 4 and 5. A lower course of panels is erected as follows. A first lower panel 10A is secured to a structural member 29 of the building framework by means of a clip member 30 and a fastener 31 positioned at the first longitudinal edge 11A as shown in FIG. 4. A second lower wall panel 10B is erected in side-by-side interlocked relation with the first lower wall panel 10A and is secured to the structural member 29 by additional ones of the clip 30 and the fastener 31. The remaining wall panels of the lower course are similarly erected.

A bead 32 of resilient sealing material is disposed inboard of the lapping ends of the upper panels and the bead 32 preferably is applied to the end faces of the insulating cores 15 of the lower wall panels 10A, 10B following the contour of the outer skins thereof.

A second or upper course of wall panels is erected as follows. A first upper wall panel 10C is positioned above the first lower wall panel 10A as shown in FIG. 4; and then the wall panel 10C is moved downwardly placing the lapping end 26C thereof over the upper end 24A as shown in FIG. 5. The first upper wall panel 10C is secured to the structural member 29 by the clip 30 and the fastener 31 (not shown). Thereafter the lapping end 26D of a second upper wall panel 10D is placed over the upper end 24B of the second lower wall panel 10B and slid laterally toward the first upper wall panel 10C into side-by-side interlocked relation therewith as illustrated in FIG. 5 and is secured to the structural member 29. The remaining panels of the upper course are similarly erected. The resulting four corner joint of this invention is imperceptible.

It will be observed in FIG. 5 that the sealant bead 32 is compressed between the end faces of the insulating cores and preferably contacts the lapping ends 26 of the upper wall panels to establish a weather-tight seal. Beads 33, 34 of a resilient sealing material which are applied to the structural member 29 and which are ultimately compressed between the upper and lower ends of the panels 10 and the structural member 29, establish interior seals on opposite sides of the confronting ends of the upper and lower wall panels. Interior seals are required where air containment is specified. That is in those instances where gases and liquids from within the building must not escape to the atmosphere. Interior seals also are required in those instances where limits to the amount of gases and liquids entering the building are specified.

I claim:

1. A four corner joint between upper wall panels having lower ends secured to a structural member and lower wall panels having upper ends secured to the same structural member; each of said wall panels comprising outer and inner sheet metal skins connected by an insulating core and having marginal connecting means formed along the opposite longitudinal edges of the outer sheet metal skins; the outer and inner sheet metal skins and the core coterminate at said upper ends of said lower wall panels, the inner sheet metal skin and the core coterminate at said lower ends of said upper wall panels and confront said upper ends of said lower wall panels, the outer sheet metal skins of said upper wall panels having lapping ends extending beyond said lower ends of said upper wall panels and overlapping said lower wall panels, and said marginal connecting means being substantially entirely removed along the length of said lapping ends to preclude interfering with the interconnection of the corresponding marginal connecting means of said lower wall panels.

2. The joint as defined in claim 1 wherein said marginal connecting means comprise a tongue and a channel defining a complementary groove, and wherein along the length of said lapping ends, a longitudinal edge strip of said tongue is removed and said channel is removed in its entirety.

3. The joint as defined in claim 1 including a bead of sealant material compressed between the confronting end faces of the insulating cores of the upper and lower wall panels to provide a weathertight seal.

4. The joint as defined in claim 3 wherein said bead of sealant material contacts the inner faces of said lapping ends.

* * * * *